United States Patent [19]

Griebel

[11] 4,208,846

[45] Jun. 24, 1980

[54] AWNING

[76] Inventor: William C. Griebel, 291 Portwind Pl., Ballwin, Mo. 63011

[21] Appl. No.: 935,983

[22] Filed: Aug. 22, 1978

[51] Int. Cl.[2] ..... E04F 10/08

[52] U.S. Cl. ..... 52/74; 52/667

[58] Field of Search ..... 52/74–78, 52/473, 666, 667, 668

[56] References Cited

U.S. PATENT DOCUMENTS

| | | | |
|---|---|---|---|
| 47,524 | 5/1865 | Corduan | 350/263 |
| 227,920 | 5/1880 | Pohl | 49/86 |
| 349,810 | 9/1886 | Pohl | 52/69 |
| 396,309 | 1/1889 | Teupe | 52/78 |
| 2,597,225 | 5/1952 | Chrosnik | 49/86 |
| 2,752,644 | 7/1956 | Mortrude | 52/78 |
| 2,814,079 | 11/1957 | Van Fleet et al. | 52/473 |
| 2,894,296 | 7/1959 | Scoccia | 52/473 |
| 2,952,049 | 9/1960 | Vetere | 49/87 |
| 3,039,155 | 6/1962 | Iacovoni | 49/65 |
| 3,113,356 | 12/1963 | Piper | 52/473 |
| 3,438,167 | 5/1969 | Royston | 52/473 |
| 3,662,503 | 5/1972 | Praisler | 52/97 |
| 3,729,874 | 5/1973 | Albany | 52/75 |
| 4,050,366 | 9/1977 | Wiklund et al. | 52/473 |

OTHER PUBLICATIONS

Praisler, U.S. Pat. 3,662,503 dated 5-1972.

*Primary Examiner*—James L. Ridgill, Jr.
*Attorney, Agent, or Firm*—J. Philip Polster

[57] ABSTRACT

An easily installed awning includes a pair of side frame members and a plurality of generally vertical slats carried by slots in the upper surfaces of the side members.

8 Claims, 7 Drawing Figures

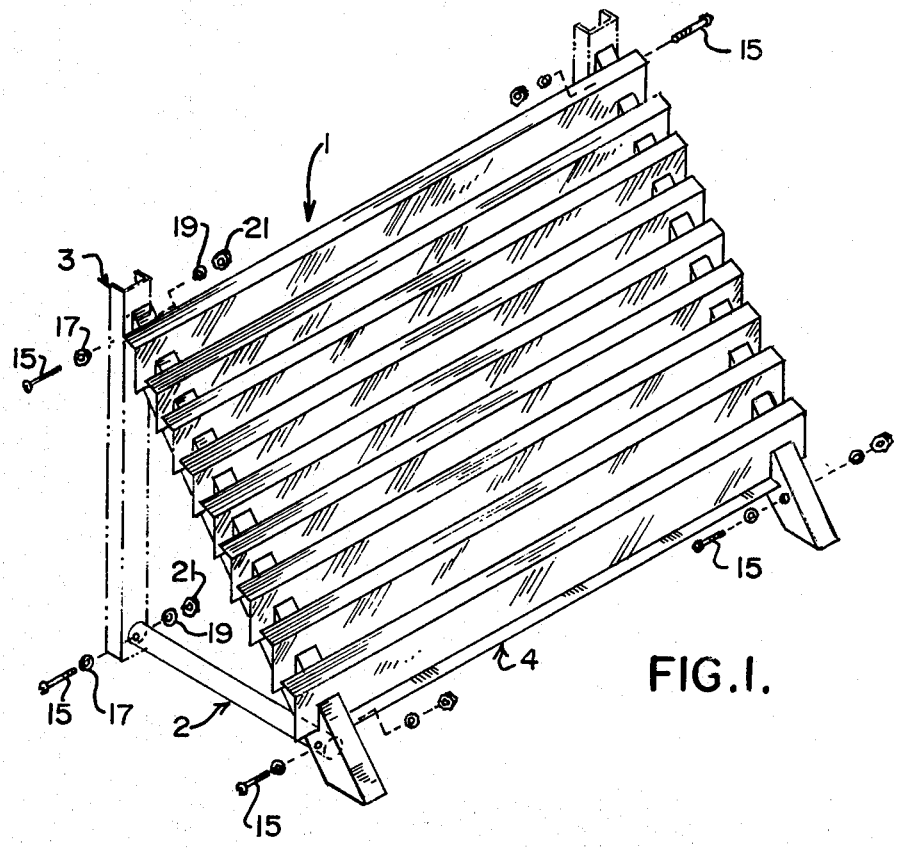
FIG.1.
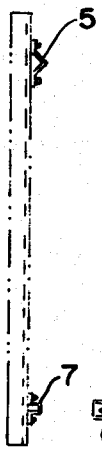
FIG.2.
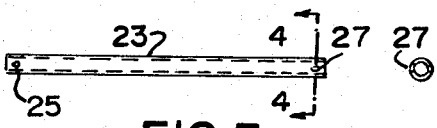
FIG.3.
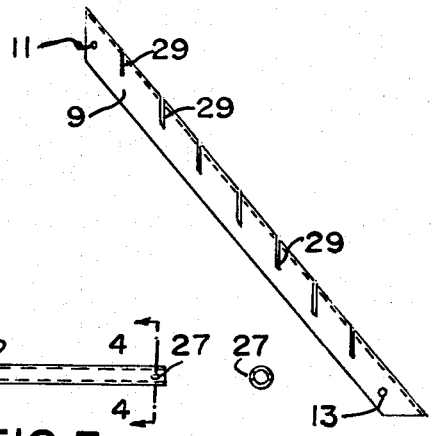
FIG.4.
FIG.5.
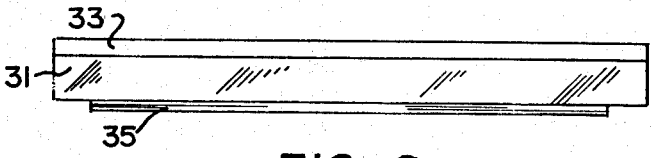
FIG. 6.
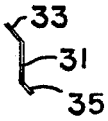
FIG.7.

AWNING

BACKGROUND OF THE INVENTION

This invention relates to an awning of the type commonly installed above a window or door to reduce the amount of sunlight reaching into a building. This type of awning is referred to herein as a window awning.

Previously known window awnings have been heavy and difficult to install and remove.

SUMMARY OF THE INVENTION

One of the objects of this invention is to provide a window awning which is easy for even one person to install and take down.

Another object is to provide such an awning which is light-weight yet sturdy.

Other objects will become apparent to those skilled in the art in the light of the following description and accompanying drawings.

In accordance with this invention, generally stated, an awning suitable for attachment to a window or door frame of a building structure is provided, said awning comprising bracket means mounted on the building structure, a pair of spaced-apart vertical frame members attached to the bracket means, each of the frame members including means defining a downwardly and outwardly sloping slat-mounting surface, a plurality of slots in the frame members, the slots extending through said slat-mounting surface, and a plurality of generally vertical slats, each of the slats extending through and being carried solely by frictional engagement with the sides of the slots.

In the preferred embodiment, the slots and slats are generally vertical. As used herein, the term "generally vertical" indicates plus or minus about twenty degrees from the vertical.

BRIEF DESCRIPTION OF THE DRAWINGS

FIG. 1 is a view in perspective of one embodiment of awning of the present invention.

FIG. 2 is a view in side elevation of a pair of brackets for supporting the awning.

FIG. 3 is a view in side elevation of a lower support member of a side frame member of the awning.

FIG. 4 is a sectional view taken along the line 4—4 of FIG. 3.

FIG. 5 is a view in side elevation of an inverted U-channel part of the side frame member.

FIG. 6 is a view in front elevation of a slat member of the awning.

FIG. 7 is a view in end elevation of the slat of FIG. 6.

DESCRIPTION OF THE PREFERRED EMBODIMENT

Referring now to the drawings, reference numeral 1 indicates one illustrative embodiment of awning of this invention.

The awning 1 includes a pair of spaced apart vertical frame members, indicated generally at 2, connected to the frame of a window, as indicated at 3, and nine generally vertical slats 4 held by the frame members 2.

An upper bracket 5 and a lower bracket 7 are secured to the frame 3. Each is made of formed aluminum and each is proportioned to hold a particular part of the frame 2.

Each frame member 2 includes an inverted U-channel 9, made of aluminum. Holes 11 and 13 are provided in the side walls of the inverted U-channel 9. The upper and lower ends of the inverted U-channel 9 are cut at a forty degree angle, so that when the inverted U-channel 9 is secured to the bracket 5, by aluminum bolts 15, lock washers 17 and 19, and nuts 21, the inverted U-channel 9 is held at an angle of forty degrees with respect to the vertical. The inverted U-channel 9 is thirty-one inches long along each edge. It is about one-sixteenth of an inch thick.

Each frame member 2 also includes a lower support member 23 in the form of a length of aluminum tubing. Bolts, washers and nuts 15–21 extend through a hole 25 adjacent one end of the tubing and hold the tubing to the bracket 7. The outer end of the tubing 23 includes a hole 27 through which the lower support member 23 is similarly held to the inverted U-channel 9. The lower support member is generally horizontal, is about eighteen inches long, and has a diameter of three-quarters of an inch.

The upper surface of the inverted U-channel 9 is broken by nine slots 29, cut at an angle of thirty degrees. Each of the slots is about one and a half inches deep and one-sixteenth inch wide. Measured along the upper surface of the inverted U-channel 9, the slots 29 are spaced about three and one-quarter inches apart.

The nine slats 4 each include a body part 31, a head part 33, extending the full width of the body part 31, and a tail part 35, extending less than the full width of the body part. The length of the tail part is chosen to be equal to distance between the inside faces of the vertical frame members. Preferably, the line between the body part and the tail part is partially undercut to permit the tail part to be cut easily to the appropriate length. The head part is bent forty-five degrees from the plane of the body part toward the frame 3, and the tail part is bent forty-five degrees from the plane of the body part away from the frame 3. Each slat is made of one-sixteenth inch coated steel (twenty-nine gauge), and has a length of forty inches. The body part is three inches high, the head part is one inch high, and the tail part is five-eighths inch high. The overall height of the slat is about four and one-eighth inches. It will be seen that the body parts of the slats 4 are about ten degrees from true vertical.

It will be seen that the shapes and proportions of the slats, and their spacing, provide effective screening from the sun, even from direct overhead sun, yet permit air to pass through them, so as to prevent the build-up of heat directly under the awning.

The installation of the awning of the present invention is extremely simple. The brackets 5 and 7 are secured to the frame 3 at the appropriate places. The frame members 2 are assembled and attached to the brackets. Each slat 4 is then individually slipped into its pair of slots 29.

It will be seen that the awning 1 is easily disassembled or partially disassembled for washing the slats of the window beneath the awning, or for storage in the winter. If the awning is left assembled in the winter, its design permits ice and snow to fall through, and thereby avoids damage caused by heavy vertical loads.

Numerous variations in the awning of this invention, within the scope of the appended claims, will occur to those skilled in the art in light of the foregoing disclosure.

What is claimed is:

1. An awning suitable for attachment to a window or door frame of a building structure, said awning comprising (a) bracket means fixedly mounted on said building structure, (b) a pair of spaced-apart vertical frame members fixedly attached to said bracket means, each of said frame members including means defining a downwardly and outwardly sloping slat-mounting surface, (c) a plurality of slots in said frame members, said slots extending through said slat-mounting surface, (d) a plurality of slats, each of said slats extending through and being carried by frictional engagement with the sides of said slots, each of said slats including a broad body part constituting the major portion of said slat, said body part being held vertical, plus or minus twenty degrees, by said slots in said frame members.

2. The awning of claim 1 wherein said slats each include a head part bent at an angle to the body part, and a tail part bent at an opposing angle to the body part, said head part and said tail part being so proportioned that the edges of adjacent said slats are in general vertical alignment to provide effective screening from direct overhead sun.

3. The awning of claim 2 wherein said body part, said head part and said tail part are all planar, whereby said slats may be stacked with all faces of adjacent said slats abutting when said awning is disassembled.

4. The awning of claim 3 wherein said body parts of said slats are held at an angle of about ten degrees with respect to vertical.

5. The awning of claim 1 or 3 wherein said slats are spaced from each other a distance, measured along said slat supporting surface, at least as great as the height of said body part.

6. The awning of claim 2 wherein the head part is bent about forty-five degrees toward said building structure with respect to said body part, and wherein said tail part is bent about forty five degrees away from said building structure with respect to said body part.

7. The awning of claim 4 wherein said tail part abuts said side frame members and provides lateral stiffening to said awning, said tail part extending solely between said frame members, said slats comprising only said head part and said body part beyond said frame members, whereby the distance between said frame members may be decreased by removing a portion of said tail part.

8. The awning of claim 1 wherein said vertical frame members each comprise an inverted U-channel, the upper surface of said channel being said slat-mounting surface, and a lower support bar, the upper end of said inverted U-channel being connected to said bracket means and one end of said lower support bar being connected to said bracket means, the other end of said lower support bar being pivotably connected to said inverted U-channel, and being pivotable into said U-channel when said awning is disassembled.

* * * * *